US006402139B1

(12) United States Patent
Kanno

(10) Patent No.: US 6,402,139 B1
(45) Date of Patent: Jun. 11, 2002

(54) SHEET MATERIAL FEEDER WITH GUIDES AND LATERAL POSITION ADJUSTING MEANS

(75) Inventor: Takuma Kanno, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/577,609

(22) Filed: May 25, 2000

(30) Foreign Application Priority Data

May 27, 1999 (JP) ..... 11-147975

(51) Int. Cl.[7] ..... B65H 9/00

(52) U.S. Cl. ..... 271/240; 271/254; 271/251; 271/264

(58) Field of Search ..... 271/225, 240, 271/251, 250, 253, 254, 301, 291, 186

(56) References Cited

U.S. PATENT DOCUMENTS 4,432,541 A * 2/1984 Clark et al. ..... 271/251
4,814,825 A * 3/1989 Johdai et al. ..... 271/186
5,091,754 A * 2/1992 Abe et al. ..... 271/240
5,172,138 A * 12/1992 Okazawa et al. ..... 271/240
5,507,482 A * 4/1996 Tenpaku et al. ..... 271/251
5,690,325 A * 11/1997 Morimoto ..... 271/186
5,937,260 A * 8/1999 Terinaka et al. ..... 271/240
6,123,331 A * 9/2000 Vackier et al. ..... 271/253
6,206,367 B1 * 3/2001 Jo ..... 271/253

FOREIGN PATENT DOCUMENTS

EP 0 848 301 A1 6/1998

* cited by examiner

*Primary Examiner*—H. Grant Skaggs
(74) *Attorney, Agent, or Firm*—Fitzpatrick, Cella, Harper & Scinto

(57) ABSTRACT

A sheet material feeder and an image forming apparatus in which, even when a sheet of thick paper is transported through a sharply curved sheet material guide, the sheet can be adjusted to a lateral registry position. A base plate, a movable lower guide and a movable upper guide can slide in a direction perpendicular to the direction of sheet transport in union with each other. Where a sheet material stopped at a lateral registry adjustment position is a sheet of thick paper, it is brought into a tightly stretching condition supported at three points, i.e., a crotch point of the movable upper guide, a top of the movable lower guide, and a guide surface of a regulation-side lateral register plate. The sheet material supported from both sides at the three points is moved together with the movable lower guide and the movable upper guide toward a reference-side lateral register plate for abutment against the same, whereby the lateral registry position adjustment of the sheet material is completed.

17 Claims, 16 Drawing Sheets

SHEET MATERIAL FEEDER WITH GUIDES AND LATERAL POSITION ADJUSTING MEANS

BACKGROUND OF THE INVENTION

1. Field of the Invention

The present invention relates to a sheet material feeder provided in image forming apparatuses such as printers, copying machines and facsimiles. More particularly, the present invention relates to a sheet material feeder provided with sheet-material lateral position adjusting means for adjusting a widthwise position of a sheet material (referred to hereinafter as "lateral registration"), and an image forming apparatus including the sheet material feeder.

2. Description of the Related Art

Conventional image forming apparatuses such as printers, copying machines and facsimiles sometimes include a sheet material feeder provided with a reversing mechanism for turning a sheet material upside down to print an image on the second or opposite side of the sheet material. By way of example, FIG. 11 shows an overall construction of such a conventional image forming apparatus provided with a sheet material reversing mechanism.

In FIG. 11, a sheet supply cassette N accommodating a number of sheet materials S piled one above another is detachably attached to a bottom portion of an image forming apparatus body M.

Numeral 1 denotes a sheet feed roller, and 2 denotes a transport roller in pressure contact with a pair of rollers 2*a*, 2*b*. Numeral 3 denotes a register roller pair, 4 denotes a photoconductive drum, and 5 denotes a transfer roller. Numeral 6 denotes a fusing roller pair, 7 denotes a transport roller pair, and 8 denotes a transport roller capable of rotating forward and backward selectively (referred to as a "reversing roller" hereinafter). Numeral 9 denotes a semicircular roller having a semicircular shape in section, and 9*a* denotes a driven roll against which the semicircular roller 9 is brought in pressure contact. Numeral 10 denotes a transport roller pair, and 11 denotes a transport roller pair with the function of removing a curl from the sheet. Numeral 12 denotes a scanner mechanism, 13 denotes a returning mirror, and 14 denotes a sheet ejection tray. Numeral 15 denotes a flapper for changing the direction of transport of the sheet material S, and 16 denotes a guide in the form of a pair of sheet material guide plates.

A beam of light scanned by a scanner 12 is introduced to the photoconductive drum 4 after being reflected by the returning mirror 13.

In the image forming apparatus shown in FIG. 11, the guide 16 serves as sheet-material lateral position adjusting means for adjusting a position of the sheet material S in the lateral direction.

FIG. 12 shows a detailed construction of a portion of the sheet material lateral position adjusting means including the guide 16. As shown in FIG. 12, the guide 16 comprises left and right lateral register plates (sheet-material lateral position adjusting means) 16*a*, 16*b* each being substantially U- or channel-shaped in section. The left and right lateral register plates 16*a*, 16*b* are arranged such that their openings face each other with a predetermined spacing between the plates.

One 16*b* of the lateral register plates is attached for sliding movement on a base plate 16*c*, and is biased inward by a compression spring 17 interposed between the lateral register plate 16*b* and a spring seat 16*e* of the base plate 16*c*.

The lateral register plate 16*b* engages a stopper 16*d* of the base plate 16*c* for restriction of further sliding movement and tends to be held in the engaging condition.

The base plate 16*c* of the one lateral register plate 16*b* and the other lateral register plate 16*a* are provided for movement in directions of arrows B perpendicular to the direction of transport of the sheet material, and are moved by driving means such as cylinders 19*a*, 19*b*.

The cylinders 19*a*, 19*b* are controlled by a CPU (control means) 23, which is a control unit for the entirety of the image forming apparatus, through cylinder drives 20*a* and 20*b*, respectively.

A semicircular roller 9 is disposed approximately midway between the left and right lateral register plates 16*a*, 16*b* in the direction perpendicular to the direction of transport of the sheet material, and rotation of a motor 9*b* is transmitted to the semicircular roller 9. The motor 9*b* is controlled by the CPU 22 through a motor driver 21.

Returning to FIG. 11, the sheet material S advanced by the sheet feed roller 1 from the sheet supply cassette N is introduced to a nip between the transport roller 2 and the roller 2*a*, and is further transported to the register roller pair 3.

Then, the sheet material S is advanced by the register roller pair 3 toward the photoconductive drum 4 in timed relation therewith, and a toner image formed on the photoconductive drum 4 is transferred onto the sheet material S.

Subsequently, the sheet material S is transported to the fusing roller pair 6 for permanent fusing of the toner image. The sheet material S is then fed to the flapper 15 by the transport roller pair 7.

In the case of printing images on both surfaces of the sheet material S, the sheet material S with an image having been printed on a first surface thereof is fed by transport roller pair 7 and guided in a direction of arrow C by the flapper 15 held in a posture indicated by broken lines, and is then introduced to the reversing roller 8.

FIG. 13 shows in detail a manner of turning the sheet material S upside down with the reversing roller 8. The sheet material S having been advanced in the direction C passes a crotch point 18*a* positioned at a lower end of a guide 18, and a leading end of the sheet material S reaches sensors 23*a*, 23*b* which serve as sheet-material detecting means which are disposed downstream of the crotch point 18*a*.

Upon the sensors 23*a*, 23*b* detecting the leading end of the sheet material S, a reversing roller pair 8*a*, 8*b* are rotated in directions of respective solid-line arrows to advance the sheet material S until a tailing end of the sheet material S is detected by the sensors 23*a*, 23*b*.

Detection of the tailing end of the sheet material S indicates that the tailing end of the sheet material S has passed the crotch point 18*a*, and the reversing roller pair 8*a*, 8*b* are now rotated in directions of respective broken-line arrows.

Here, a nip between the reversing roller pair 8*a*, 8*b* is oriented in a direction D indicated by a broken-line arrow. Therefore, when the tailing end of the sheet material S has passed the crotch point 18*a* and the reversing operation is started, a new leading end (the tailing end before the reversing operation) of the sheet material S is forwarded to move in the direction D. The sheet material S advanced in the direction D is introduced to the guide 16.

The CPU 22 shown in FIG. 12 receives detection signals from the sensors 23*a*, 23*b* (these being denoted by 23 in FIG. 12), and controls the semicircular roller 9 and the lateral register plates 16*a*, 16*b* in accordance with the received detection signals.

The sheet material S is transported in the reversed state by the reversing roller 8, and is further transported by the semicircular roller 9 and the driven roll 9*a* until the tailing end of the sheet material S passes beyond the reversing roller 8. The sheet material S is then stopped while it locates in channel-shaped grooves of the lateral register plates 16*a*, 16*b*.

At the time when the sheet material S enters the channel-shaped grooves of the lateral register plates 16*a*, 16*b*, the lateral register plates 16*a*, 16*b* are positioned so as to provide a spacing therebetween which is greater than the width of the sheet material S. Subsequently, the base plate 16*c* of the one lateral register plate 16*b* and the lateral register plate 16*a* are moved in the directions of respective arrows B perpendicular to the direction of transport of the sheet material to reference positions that are different depending on the size of each sheet material, thereby adjusting a lateral registry position of the sheet material S in the lateral register plates 16*a*, 16*b*.

FIG. 14 shows the lateral register plates 16*a*, 16*b* with the spacing therebetween greater than the width of the sheet material S; that is, at the time when the sheet material S enters the channel-shaped grooves of the lateral register plates 16*a*, 16*b*. If the sheet material S in the guide 16 is skewed as shown in FIG. 14, the skew of the sheet material S is corrected because the sheet material S is pushed by the lateral register plates 16*a*, 16*b* which are moved in the directions of respective arrows B.

More specifically, the lateral register plate 16*a* pushes a lateral edge S1 of the sheet material S to turn the sheet material S in a direction to cancel the skew, and the lateral register plate 16*b* pushes an opposite lateral edge S2 of the sheet material S to turn the sheet material S in the same direction. As a result, the skew of the sheet material S is eliminated.

When the base plate 16*c* and the lateral register plate 16*a* are stopped in the reference positions, the sheet material S is positioned without play between both the lateral register plates 16*a*, 16*b* as shown in FIG. 15. At the same time, lateral register plate 16*b* is urged by the compression spring 17 toward lateral register plate 16*a* and the sheet S is correctly held in the lateral registry position.

Returning to FIG. 11 and continuing the description, after the lateral registry position of the sheet material S has been adjusted, the sheet material S is introduced to the transport roller pair 10 by the semicircular roller 9 and the driven roll 9*a*. When the sheet material S is introduced to the transport roller pair 10, the lateral register plates 16*a*, 16*b* are moved back to the original positions providing a spacing therebetween greater than the width of the sheet material S.

Then, the sheet material S is introduced to a nip between the transport roller 2 and the roller 2*b*, and is further introduced to the nip between the transport roller 2 and the roller 2*a*. After that, the sheet material S is transported to the register roller pair 3 with a second surface facing upward. The sheet material S is forwarded from the register roller pair 3 to the photoconductive drum 4 where an image is printed on the second surface of the sheet material S in the same manner as in the case for the first surface.

The sheet material S having been subjected to printing on the second surface (or the sheet material S on which an image is to be printed on one surface and which has been subjected to printing) is advanced by transport roller pair 7 and guided in a direction of solid-line arrow F by the flapper 15 held in a posture indicated by solid lines in FIG. 11, and is then ejected on the tray 14 by the transport roller pair 11, which also functions to remove a sheet curl.

In the related art described above, however, because a transport path defined by the guide 18 and an opposing guide 24, both serving as sheet material guide means, are curved sharply as shown in FIG. 16, the following drawbacks have occurred.

(1) When the sheet material S is a sheet of thick paper, the sheet material S has a relatively strong stiffness. Therefore, when the sheet material S is stopped in the lateral registry adjustment position, it is urged downward by the crotch point 18*a* of the guide 18 and a guide surface 16*l* of the guide 16, and is urged upward by a top 24*a* of the guide 24. In other words, the sheet material S is brought into a tightly stretching condition supported at three points, i.e., the crotch point 18*a*, the guide surface 16*l* and the top 24*a* (as shown in FIG. 16B).

In the case where the sheet material S is transported to the guide 16 in a state skewed toward the side of the lateral register plate 16*b*, even with the lateral register plates 16*a*, 16*b* operated to move toward the reference positions in the directions of respective arrows B shown in FIG. 14, the sheet material S is not moved by the lateral register plate 16*b* in the direction of arrow B because of being supported at the three points. The urging force of the compression spring 17 is overwhelmed by the tight stretching of the sheet material S, and the lateral register plate 16*b* cannot move the sheet material toward the lateral register plate 16*a* for lateral registration.

Consequently, an image printed on the second surface of the sheet material S is skewed or shifted in the lateral direction.

(2) If the sheet material S can not be adjusted to the lateral registry position as described above and is transported to the subsequent stage while being in the skewed state, this increases a possibility that the sheet material may jam somewhere in the course of transport because of a long distance by which the sheet material must be transported until being ejected.

SUMMARY OF THE INVENTION

The present invention has been made with the view of solving the above-mentioned problems in the related art, and its object is to provide a sheet material feeder and an image forming apparatus in which, even when a sheet of thick paper is transported through sheet material guide curving to a large extent, the sheet can be surely adjusted to a lateral registry position.

In accordance with these objects, there is provided a sheet material feeder with a sheet material guide means for guiding both surfaces of a sheet material while contacting the sheet material at a plurality of sheet contact positions, the sheet material guide means comprising a pair of curved sheet material guides, sheet material lateral position adjusting means for pushing both side edges of the sheet material in a direction perpendicular to a direction of sheet transport, thereby adjusting a widthwise position of the sheet material contained in the sheet material guide means, wherein the sheet material is easily movable in the sheet material guide means, while in contact with the sheet contact positions, when the widthwise position of the sheet material is adjusted.

Preferably, the sheet material feeder includes movable projection units providing the sheet contact positions of the pair of sheet material guide units and being able to move in the direction perpendicular to the direction of sheet transport.

Preferably, the movable projection units are provided movably in a direction toward one of the pair of sheet-material lateral position adjusting units which is positioned on the reference side.

Preferably, the movable projection units are provided movably in union with a base plate of the other of the pair of sheet-material lateral position adjusting units which is positioned on the side opposite to the reference side.

Preferably, rolls capable of rotating in the direction perpendicular to the direction of sheet transport are provided in the sheet contact positions of the pair of sheet material guide units.

Preferably, a material having a small frictional resistance is provided on surfaces of the sheet contact positions of the pair of sheet material guide units.

Preferably, the sheet material feeder includes a sheet material transport unit comprising a semicircular roller having a semicircular shape in section and a roll in pressure contact with the semicircular roller, and transporting the sheet material along the pair of sheet material guide units, and the roll is disposed in a state inclined in a direction to skew the sheet material toward one of the pair of sheet-material lateral position adjusting units which is positioned on the reference side.

Also, the present invention provides an image forming apparatus comprising the sheet material feeder set forth above, and an image forming unit for forming an image on a sheet material.

Preferably, the sheet material feeder is provided in a transport path along which a sheet material having an image formed thereon by the image forming unit is transported to the image forming unit again.

With the above features, even when a sheet of thick paper is transported through the sheet material guide means curving to a large extent, the sheet can be easily moved in the direction perpendicular to the direction of sheet transport and can be surely adjusted to a lateral registry position.

DESCRIPTION OF THE PREFERRED EMBODIMENTS (First Embodiment)

A first embodiment is featured in that parts of upper and lower sheet guides of a conventional sheet material feeder are formed as separate members to make the guides movable. The other overall construction of an image forming apparatus is basically the same as in the related art, and the constructions and functions of sheet-material lateral position adjusting mechanisms are also basically the same as in the related art.

Figure 1:
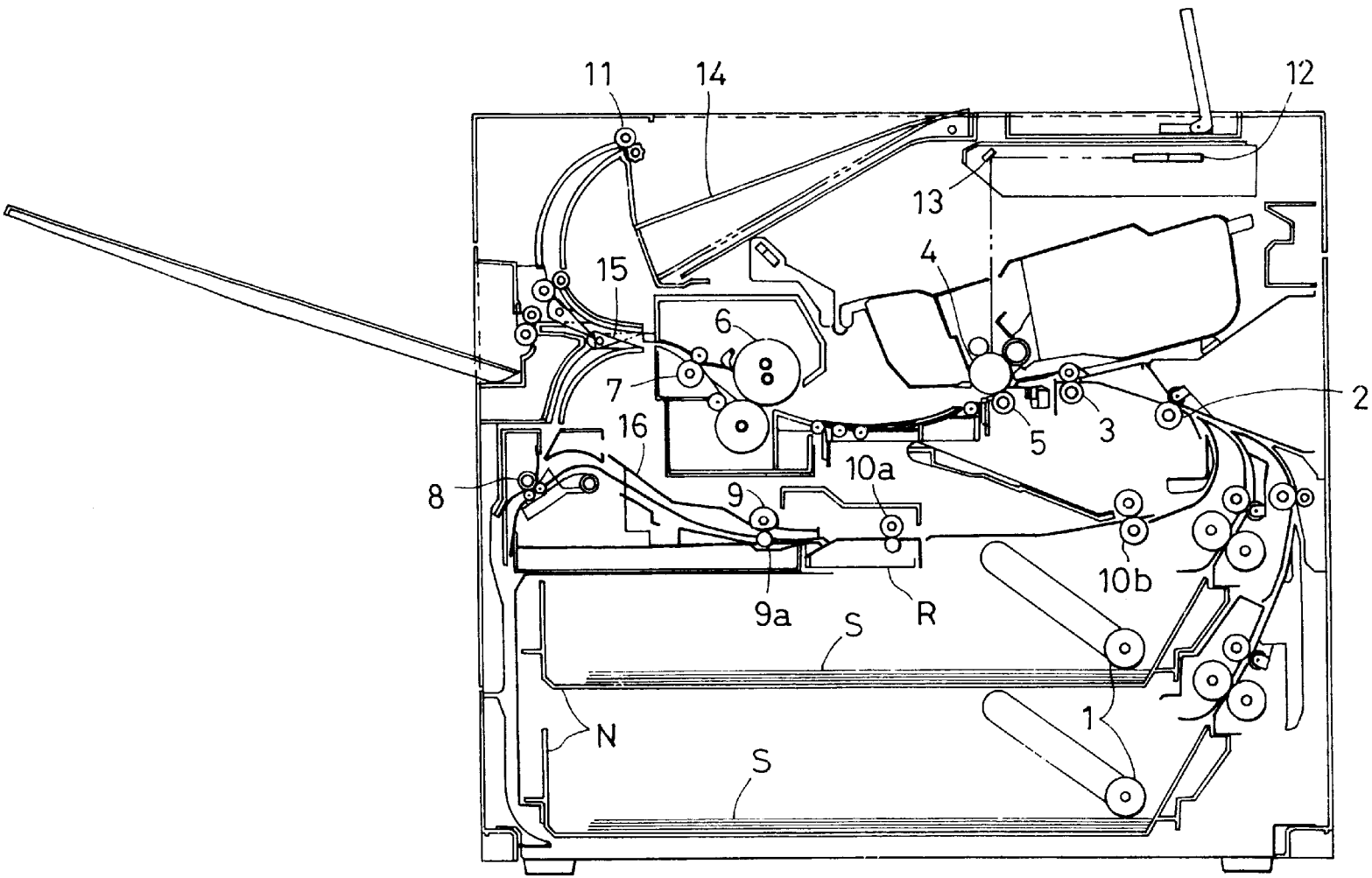
FIG. 1 is a sectional view showing an overall construction of an image forming apparatus provided with a sheet material feeder according to a first embodiment.

FIG. 1 is a sectional view showing an overall construction of an image forming apparatus provided with a sheet material feeder according to the first embodiment. In FIG. 1, the same components as those in the conventional image forming apparatus described above are denoted by the same numerals, and a description of the components having the same constructions and functions as those in the conventional apparatus is omitted here.

Figure 2:
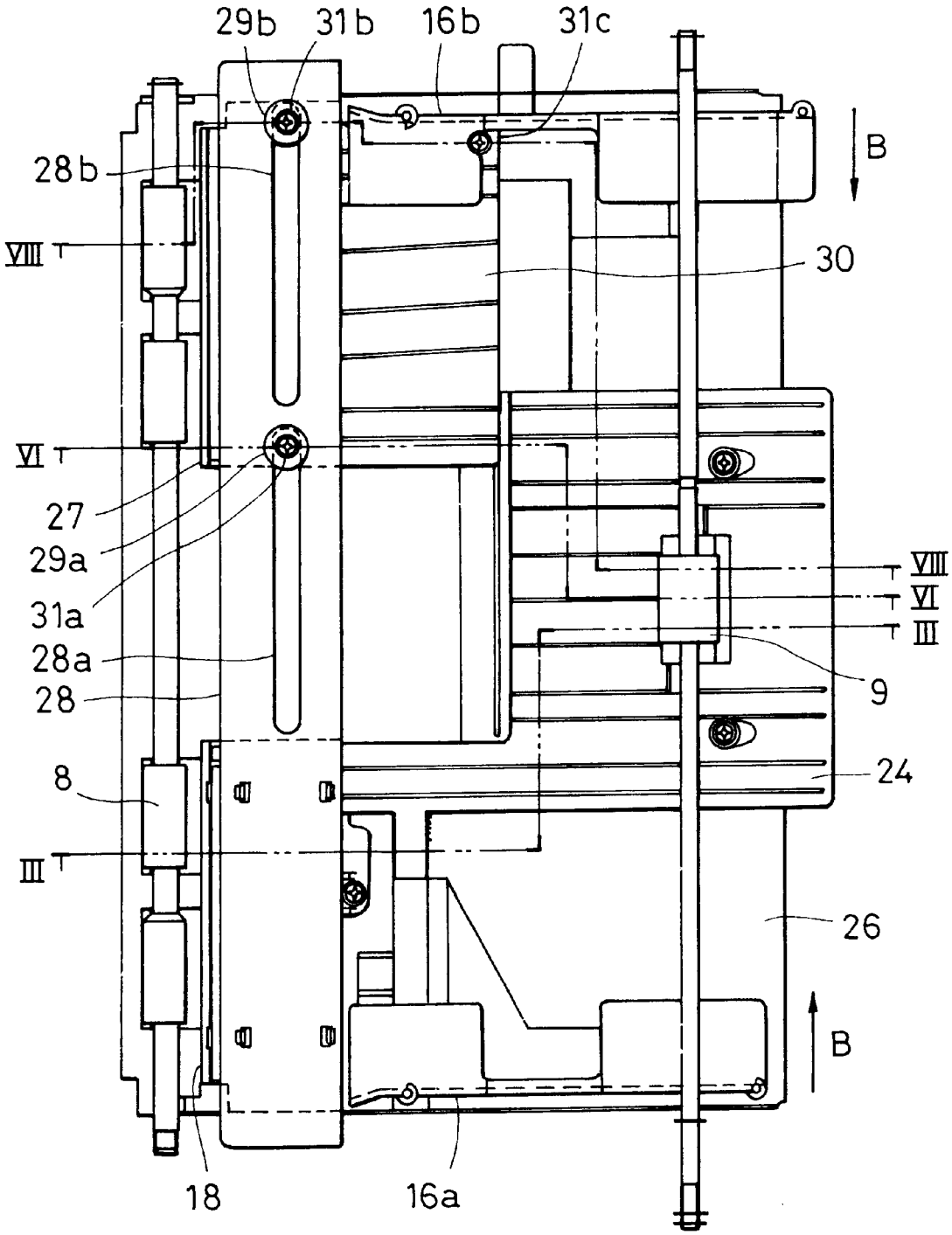
FIG. 2 is a plan view of the sheet material feeder according to the first embodiment.
Figure 3:
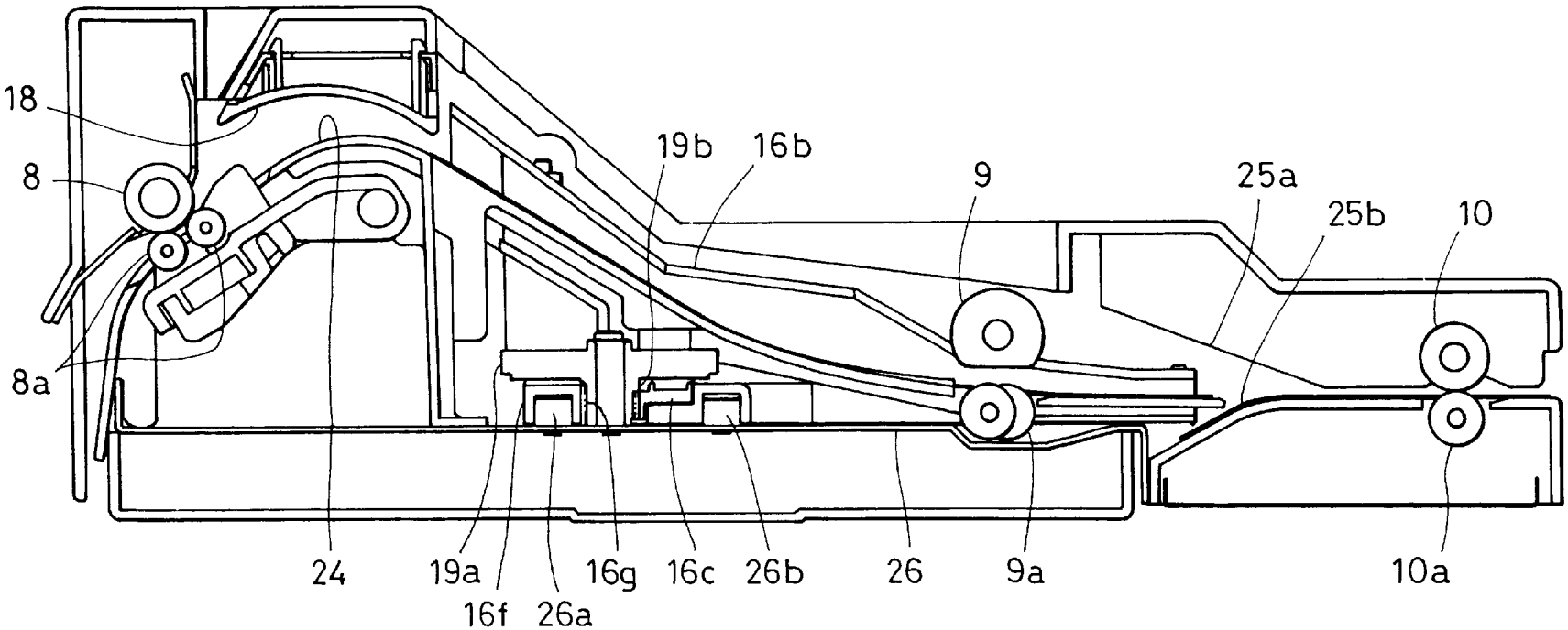
FIG. 3 is a sectional view, taken along line III—III in FIG. 2, of the sheet material feeder according to the first embodiment.

Reference letter R denotes a sheet material feeder provided with a reversing mechanism for turning a sheet material S upside down to print an image on the second or opposite side of the sheet material. FIG. 2 is a plan view of the sheet material feeder and FIG. 3 is a detailed sectional view taken along line III—III in FIG. 2.

Numeral 8 denotes a reversing roller, 8*a* denotes a roll, 9 denotes a semicircular roller, 9*a* denotes a driven roll, 10 denotes a transport roller, and 10*a* denotes a roll. Numeral 18 denotes an upper guide in a reversing area, and 24 denotes a lower guide extending from the reversing area up to a point downstream of the semicircular roller 9. Numerals 25*a*, 25*b* denote guides extending from the semicircular roller 9 to the transport roller 10.

Numerals 16*a*, 16*b* denote lateral register plates which serve as guides for guiding the sheet material S from the reversing area up to downstream of the semicircular roller 9, the guides serving also as lateral register plates (sheet-material lateral position adjusting means) for adjusting a position of the sheet material S in the widthwise direction.

Figure 4:
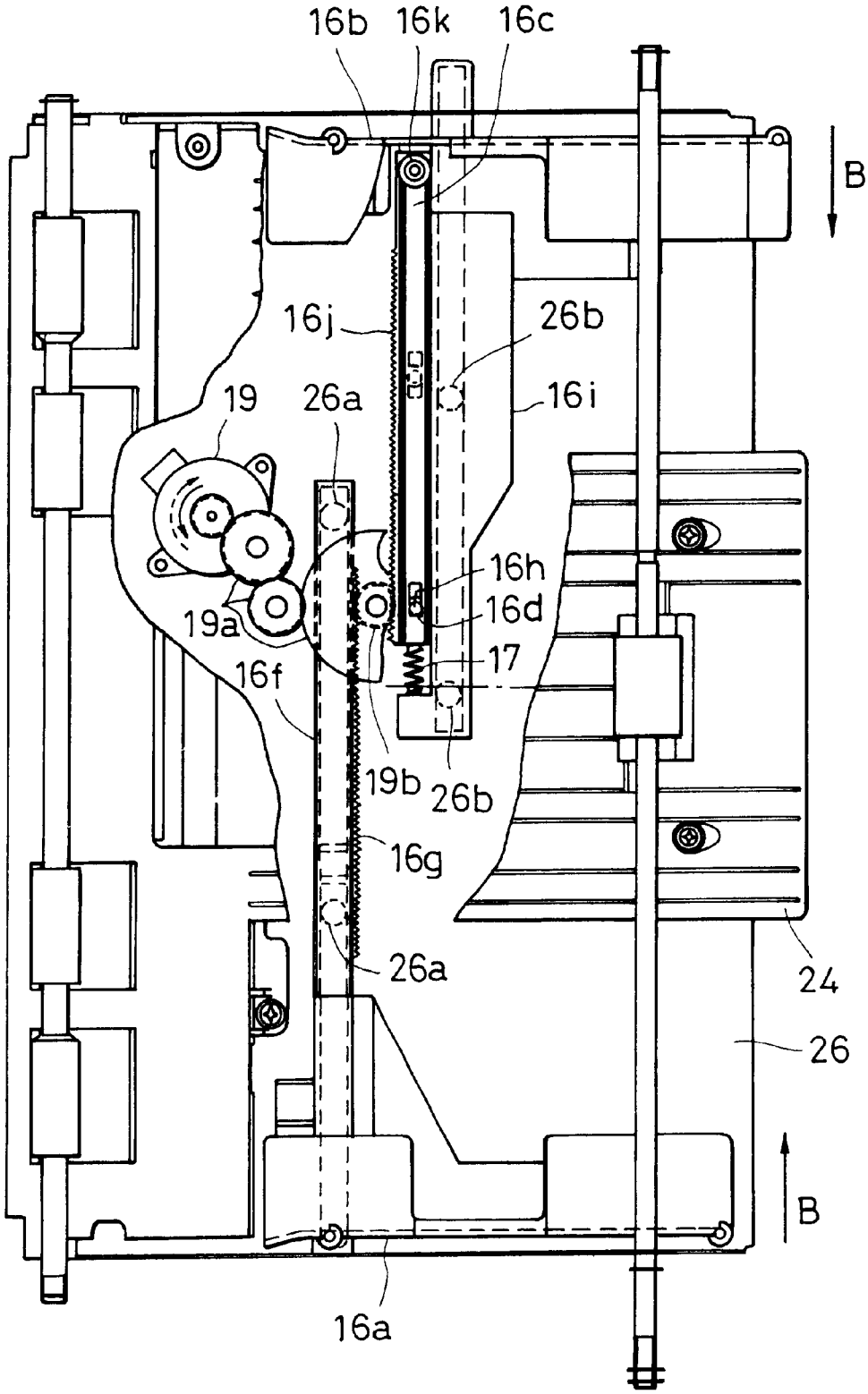
FIG. 4 is a plan view, partly broken away, of the sheet material feeder according to the first embodiment.

FIG. 4 is a plan view similar to FIG. 2, but partly broken away. The lateral register plates 16*a*, 16*b* are provided on a bottom plate 26 movable in directions of arrows B perpendicular to the direction of transport of the sheet material.

Numeral 16*f* denotes an extended portion which is extended from the lateral register plate 16*a* in the direction of arrow B, and 16*g* denotes rack teeth integrally provided on the extended portion 16*f*.

A bottom groove of the extended portion 16*f* is engaged with two guide pins 26*a* provided on the bottom plate 26 so that the lateral register plate 16*a* is slidable in the direction of arrow B.

A base plate 16*c* is attached for relative slidable movement on the lateral register plate 16*b*. Also, the lateral register plate 16*b* is biased inward by a spring 17, and inward movement of the lateral register plate 16*b* is restricted upon a projection 16*h* provided on the lateral register plate 16 engaging a stopper 16*d* of the base plate 16*c*, whereby the lateral register plate 16*b* tends to be held in the engaging condition.

Numeral 16*i* denotes an extended portion which is extended from the lateral register plate 16*b* in the direction of arrow B, and a bottom groove of the extended portion 16*i* is engaged with two guide pins 26*b* provided on the bottom plate 26 so that the lateral register plate 16*b* and the base plate 16*c* are slidable in the direction of arrow B. Numeral 16*j* denotes rack teeth integrally provided on the base plate 16*c*.

Numeral 19 denotes a drive motor, and 19*b* denotes a gear in mesh with the rack teeth 16*g*, 16*j* through a train of gears 19*a*. When the drive motor 19 is rotated in a direction of solid-line arrow, the lateral register plates 16*a*, 16*b* are moved in the directions of respective arrows B (toward the middle to narrow a spacing between both the register plates). When the drive motor 19 is rotated in a direction of broken-line arrow, the lateral register plates 16*a*, 16*b* are moved in directions opposite to the directions of respective arrows B (to widen the spacing therebetween).

Figure 5:
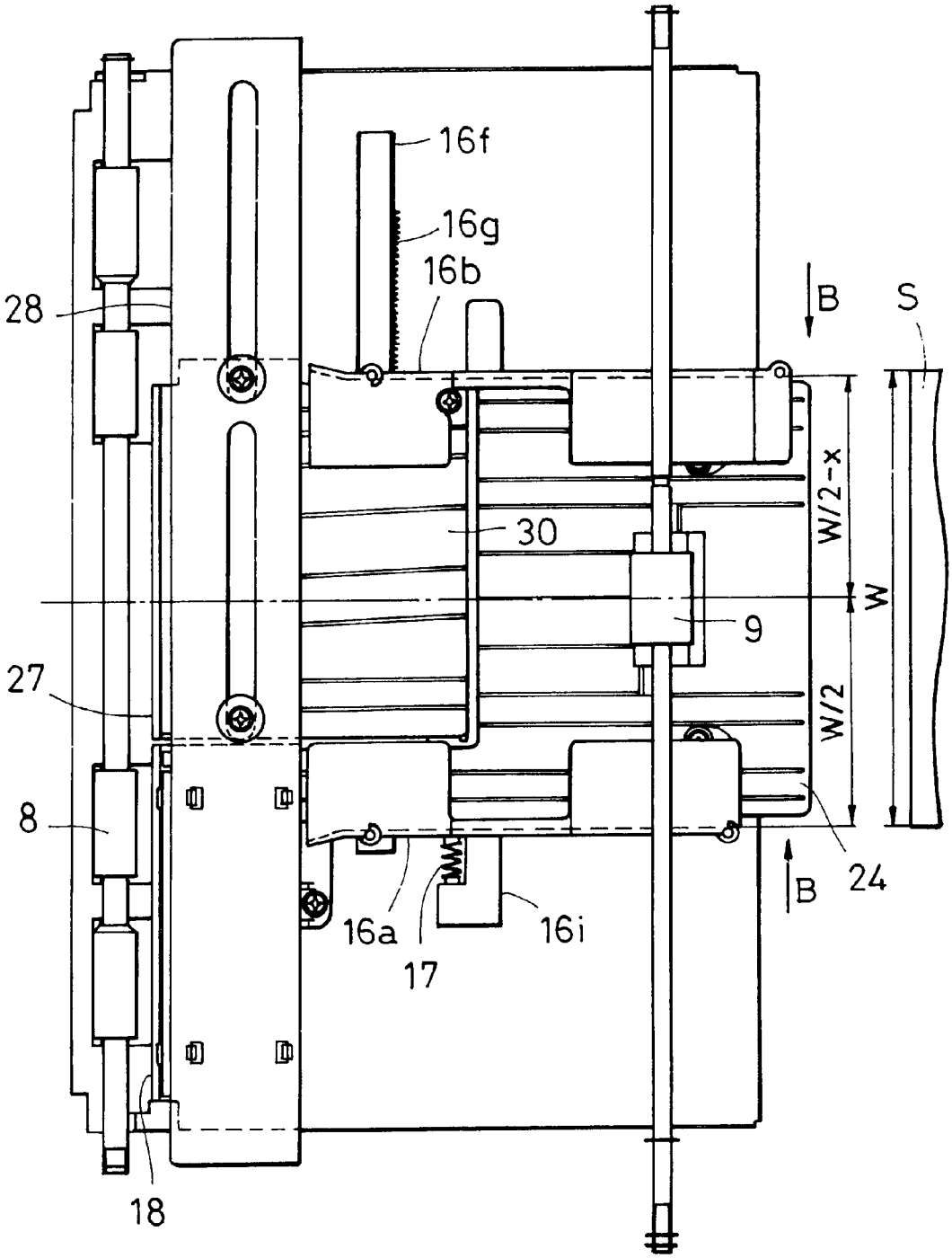
FIG. 5 is a plan view of the sheet material feeder according to the first embodiment.

The lateral register plates 16*a*, 16*b* are moved to positions corresponding to a predetermined width of the sheet material under control of a CPU (control means not shown), and are stopped there. FIG. 2 shows a condition where the lateral register plates 16*a*, 16*b* are in positions maximally spaced from each other. FIG. 5 shows a condition where the lateral register plates 16*a*, 16*b* are moved to positions corresponding to a minimum sheet material width.

Assuming that the width of the sheet material S is W, the control is set such that the lateral register plate 16*a* is stopped at a position apart W/2 from a middle point of the sheet material feeder, and the lateral register plate 16*b* is stopped at a position apart W/2−x from the middle point. Taking into account a stiffness of the sheet material S, x is usually set to satisfy x=about 1.5~2 mm. In this case, a force applied by the spring 17 to the sheet material S in the direction of arrow B through the lateral register plate 16*a* is set to the range of 40~50 gf.

Stated otherwise, the lateral register plate 16*a* serves as a reference-side lateral register plate which provides a reference for the lateral position adjustment, and the lateral register plate 16*b* serves as a regulation-side lateral register plate which pushes the sheet material S against the reference-side lateral register plate 16*a* for registration.

A description will next be made of the feature of the present invention in which the upper and lower sheet guide means are formed as separate members to make the guide means movable.

Figure 6:
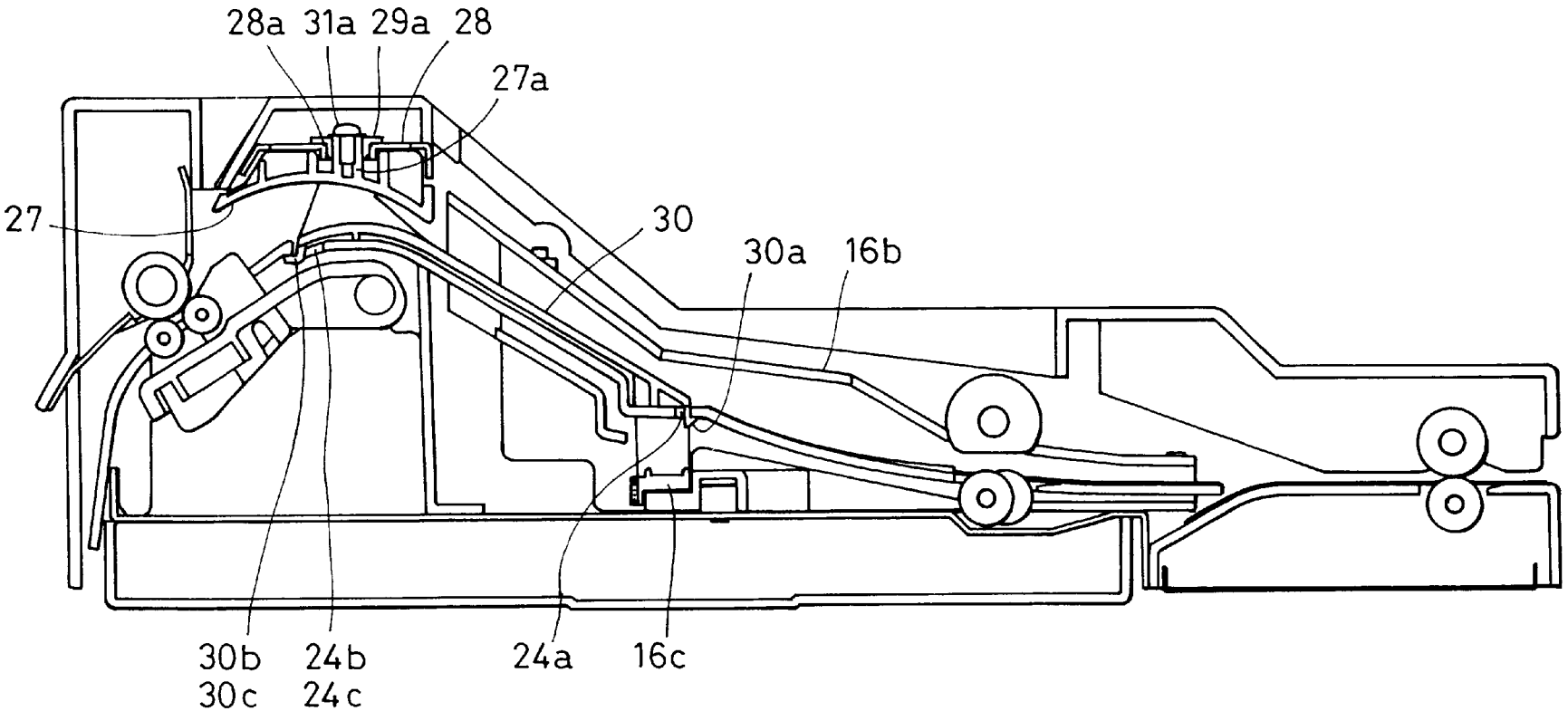
FIG. 6 is a sectional view, taken along line VI—VI in FIG. 2, of the sheet material feeder according to the first embodiment.

FIG. 6 is a detailed sectional view taken along line VI—VI in FIG. 2. Numeral 27 denotes a movable upper guide having a surface along which the sheet material S is transported and which is formed into the same shape as the upper guide 18. Numeral 28 denotes a guide stay having a slit 28*a* formed therein. A boss 27*a* is projected from the movable upper guide 27 and is engaged in the slit 28*a* through a slider 29*a*. A screw 31*a* is screwed into the boss 27*a* so that the movable upper guide 27 can slide in the directions of arrows B in FIG. 2.

Figure 7:
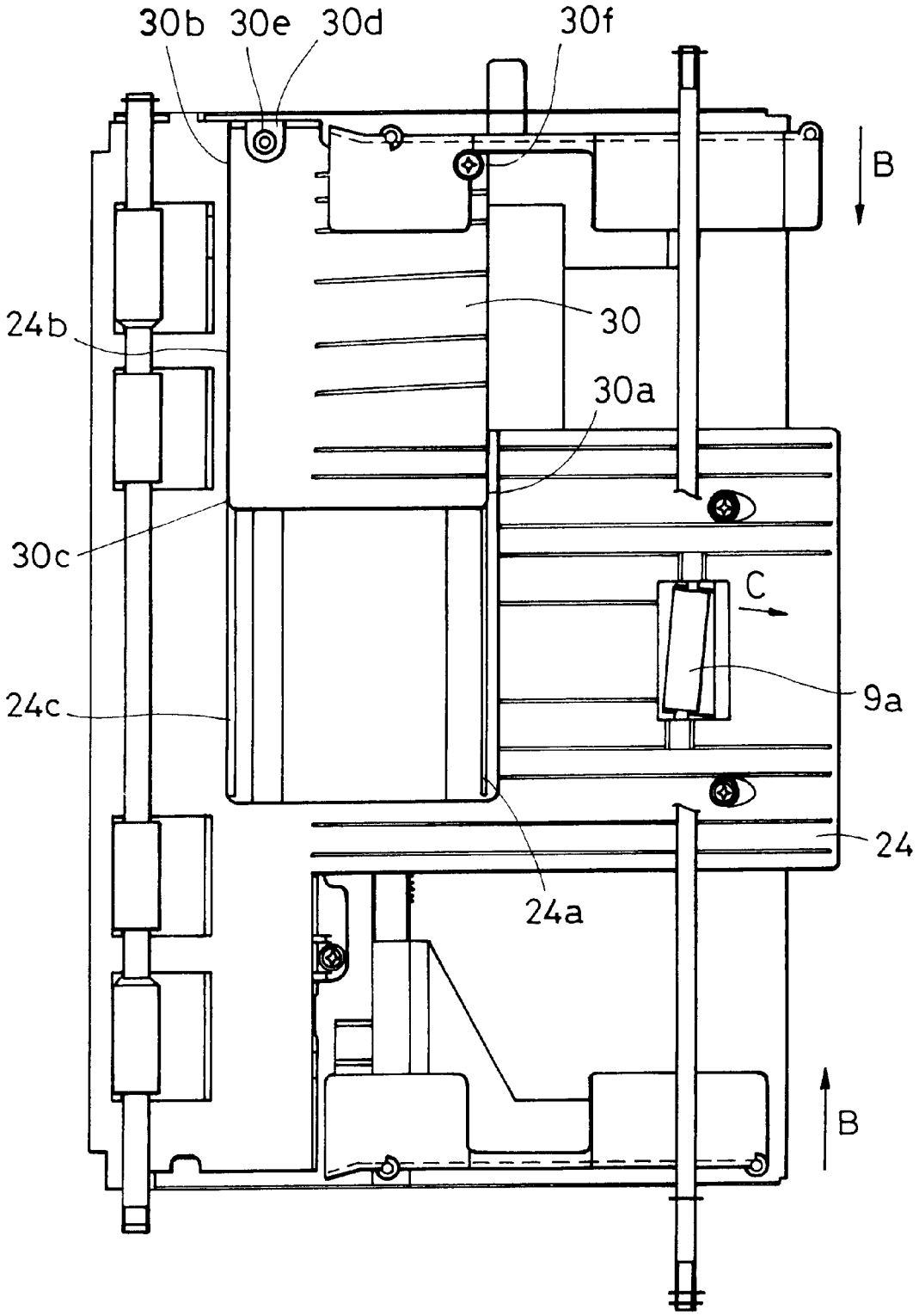
FIG. 7 is a plan view of the sheet material feeder according to the first embodiment with some parts omitted.

FIG. 7 is a plan view similar to FIG. 2, but the guide stay 28, the upper guide 18, the movable upper guide 27, the semicircular roller 9, etc. are omitted. Numeral 30 denotes a movable lower guide having a surface along which the sheet material S is transported and which is formed into the same shape as the lower guide 24. Numeral 28 denotes a guide stay having a slit 28*a* formed therein. Engagement lugs 30*a*, 30*b* and 30*c* are integrally formed on the movable lower guide 30 and are engaged respectively in grooves 24*a*, 24*b* and 24*c* formed in the lower guide 24. Thus, the movable lower guide 30 can slide in the directions of arrows B.

Figure 8:
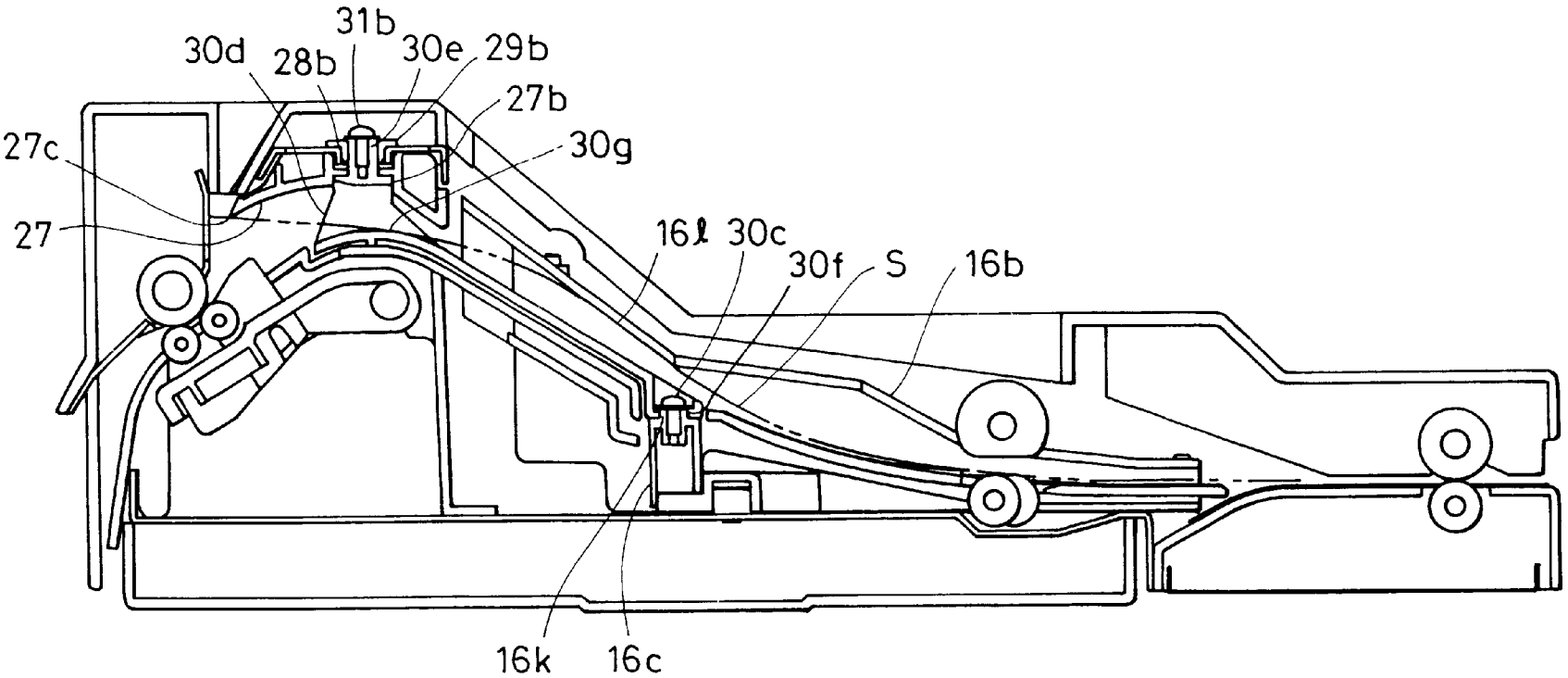
FIG. 8 is a sectional view, taken along line VIII—VIII in FIG. 2, of the sheet material feeder according to the first embodiment.

FIG. 8 is a detailed sectional view taken along line VIII—VIII in FIG. 2. The movable lower guide 30 has a joint arm 30*d* extending upward and locating sufficiently outward away from the position corresponding to the maximum width of the sheet material S.

A boss 30*e* is projected from the joint arm 30*d* and is engaged in both an engagement hole 27*b* formed in the movable upper guide 27 and a slit 28*b* formed in the guide stay 28 through a slider 29*b* with a screw 31*b* screwed into the boss 30*e*. The movable upper guide 27 and the movable lower guide 30 can therefore slide in the directions of arrows B in union with each other.

Further, a boss 16*k* is projected upward from the base plate 16*c* and is engaged in an engagement hole 30*f* formed in the movable lower guide 30 with a screw 31*c* screwed into the boss 16*k*. The movable lower guide 30 and the base plate 16*c* can slide in the directions of arrows B in union with each other.

With the construction described above, the base plate 16*c*, the movable lower guide 30 and the movable upper guide 27 can slide in the directions of arrows B in union with each other. As shown in FIG. 8, when the sheet material S stopped at the lateral registry adjustment position is a sheet of thick paper, it is brought into a tightly stretching condition supported at three points, i.e., a crotch point 27*c* of the movable upper guide 27, a top 30*g* of the movable lower guide 30, and a guide surface 16*l* of the regulation-side lateral register plate 16*b*.

A skew amount of the sheet material S is usually in the range of 2~3 mm. In this embodiment, the reference-side lateral register plate 16*a* and the regulation-side lateral register plate 16*b* are controlled to stand ready for receiving the transported sheet material S at positions 8 mm and (8−x) mm, respectively, outward away from the positions corresponding to the predetermined width of the sheet material.

Accordingly, if the sheet material S of thick paper is transported to the guide in a state skewed toward the side of the regulation-side lateral register plate 16*b*, the sheet material S is required to be moved just 2~3 mm with the lateral register position adjustment in the direction of arrow B corresponding to the skew amount. Thus, while the regulation-side lateral register plate 16*b* supported at the three points is moved through the distance (8−x) mm, the sheet material S supported at the three points is moved toward the side of the reference-side lateral register plate 16*a* to abut against the same, whereby the lateral registry position adjustment of the sheet material S is completed.

With this embodiment, as is apparent from the above description, the sheet material S is supported from both sides at three points by utilizing the stiffness of thick paper, and a lateral position of the sheet material S is adjusted by moving the three points toward the reference side. For sheet materials S which are not sheets of thick paper, and specifically, for the sheet materials S not more than 105 g/m, the sheet material S is kept from tightly stretching and hence from being caught at the three points because of a weak stiffness. The sheet material S is therefore allowed to move toward the reference side by the urging force of the spring 17 for adjustment of the lateral position.

As a result, the lateral registry position adjustment of the sheet material S can be reliably achieved. Also, since the sheet material S is transported to the subsequent stage after removal of its skew, the possibility that the sheet material may jam somewhere in the course of a long transport path is reduced.

The transport path is formed to curve slowly downstream of the lateral register plates 16*a*, 16*b*, and therefore the sheet material S is kept from stretching to such an extent that it is undesirably caught by the guide means defining the transport path.

Further, in this embodiment, the roll 9*a* held in pressure contact with the semicircular roller 9 is arranged so as to advance the sheet material S in a direction of arrow C inclined relative to the direction of transport of the sheet material, as shown in FIG. 7. This arrangement is intended to allow the sheet material S to shift more easily toward the reference-side lateral register plate 16*a* while it is advanced by the semicircular roller 9 to the transport roller 10. The roll 9*a* is commonly called a skewing roll in the art.

Moreover, in the lateral registry position adjustment carried out in this embodiment, the roll 9*a* is provided as a supplemental mechanism and the inclination of the roll 9*a* is set to a relatively small value, i.e., 5°. This is done so that when the sheet material S is a sheet of thin paper, and more specifically, when the sheet material S is not more than 60 g/m, the sheet material S is not so strongly pressed against the reference-side lateral register plate 16*a* as to buckle.

Although the above embodiment has been described in connection with the sheet material guide means for supporting a sheet material at three points, the present invention is also applicable to any sheet material guide means for supporting a sheet material at a plurality of points.

(Second Embodiment)

Figure 9:
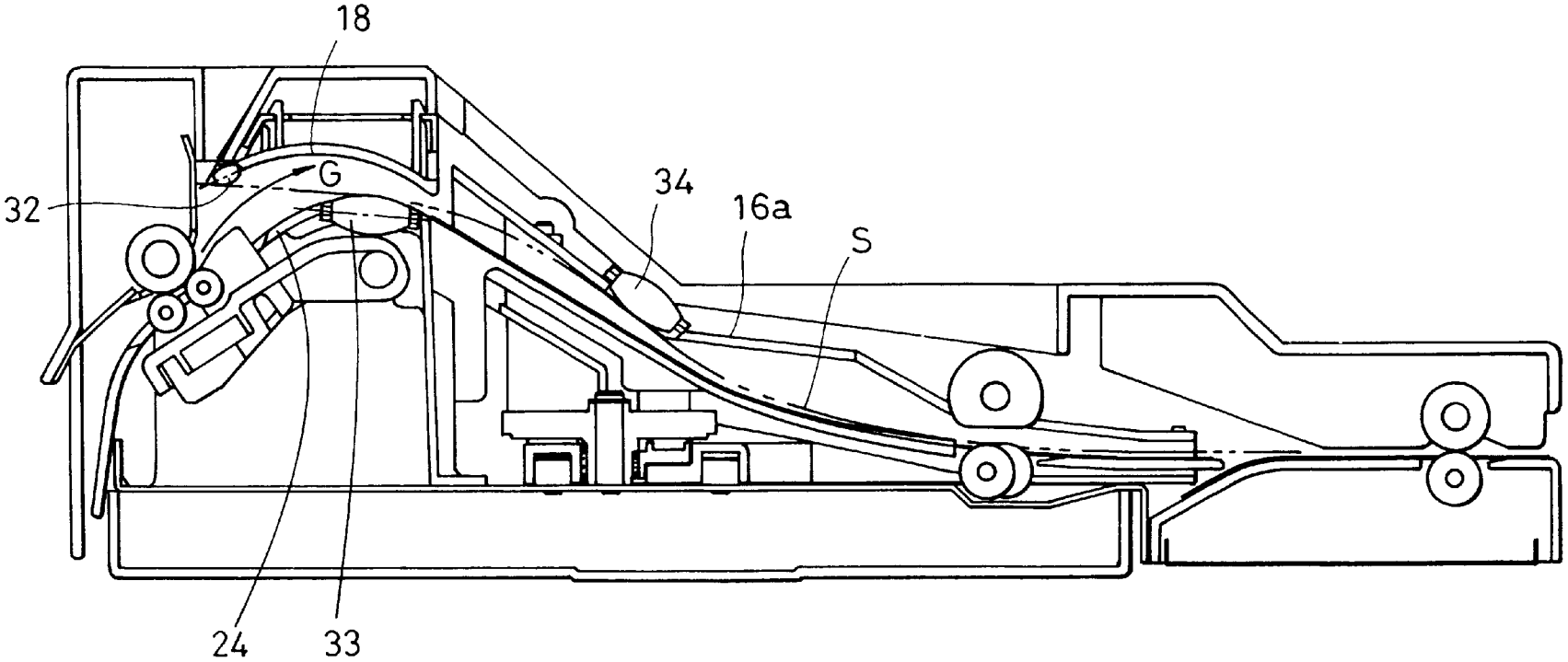
FIG. 9 is a sectional view of a sheet material feeder according to a second embodiment.

FIG. 9 shows another example of the construction of the upper and lower sheet material guide means and the reference-side lateral register plate which are included in the above-described sheet material feeder of the first embodiment.

A roll 32 capable of rotating in the direction perpendicular to the direction of sheet transport is provided in an upper guide 18 of this second embodiment, and a roll 33 capable of rotating in the direction perpendicular to the direction of sheet transport is provided in a lower guide 24.

Further, a roll 34 capable of rotating in the direction perpendicular to the direction of sheet transport is provided in a reference-side lateral register plate 16*a*.

The rolls 32 and 33 are disposed in predetermined sheet contact positions on the side nearer to the reference-side lateral register plate 16*a* in the direction perpendicular to the direction of sheet transport.

With the above construction, when the lateral registry position of the sheet material S is adjusted, the sheet material S is supported from both sides by the three rolls 32, 33 and 34. Therefore, when the regulation-side lateral register plate 16*b* is moved in the direction of arrow B, the sheet material S is also smoothly moved in the same direction of arrow B. In other words, the biasing force of the compression spring 17 is not overwhelmed by the tight stretching of the sheet material S, and the regulation-side lateral register plate 16*b* can move the sheet material S toward the reference-side lateral register plate 16*a* for lateral registration.

In addition, the rolls 32, 33 and 34 are each formed into a barrel-like shape having an outer diameter reduced at both ends in order that, when the sheet material S is advanced in a direction of arrow G shown in FIG. 9, the rolls will not interfere with transport of the sheet material S. As with the first embodiment, this second embodiment is advantageous because the lateral registry position adjustment of the sheet material S can be reliably achieved. Further, since the sheet material S is transported to the subsequent stage after removal of its skew, a possibility is reduced that the sheet material may jam somewhere in the course of a long transport path until being ejected.

An advantage specific to this second embodiment is that the sheet material S can be more smoothly moved by the use of the rolls 32, 33 and 34.

(Third Embodiment)

Figure 10:
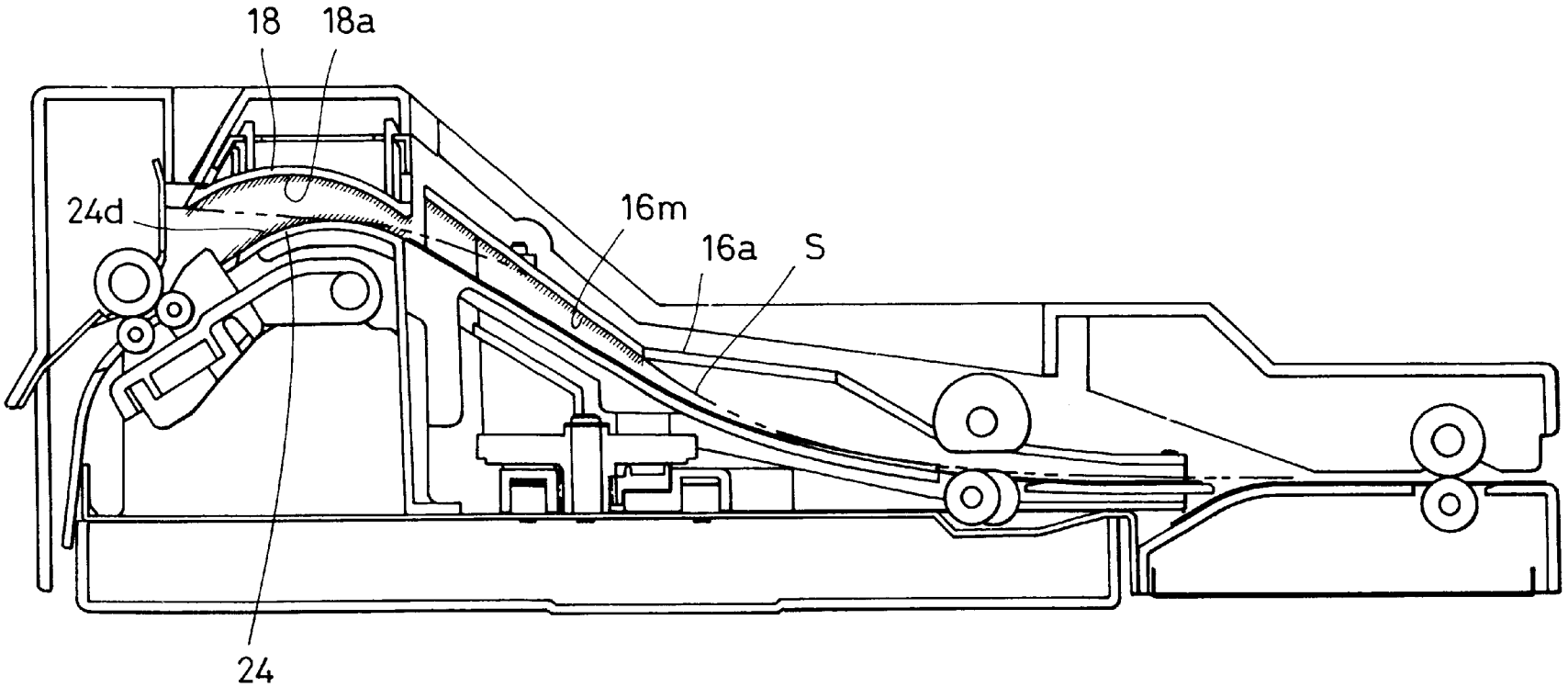
FIG. 10 is a sectional view of a sheet material feeder according to a third embodiment.
Figure 11:
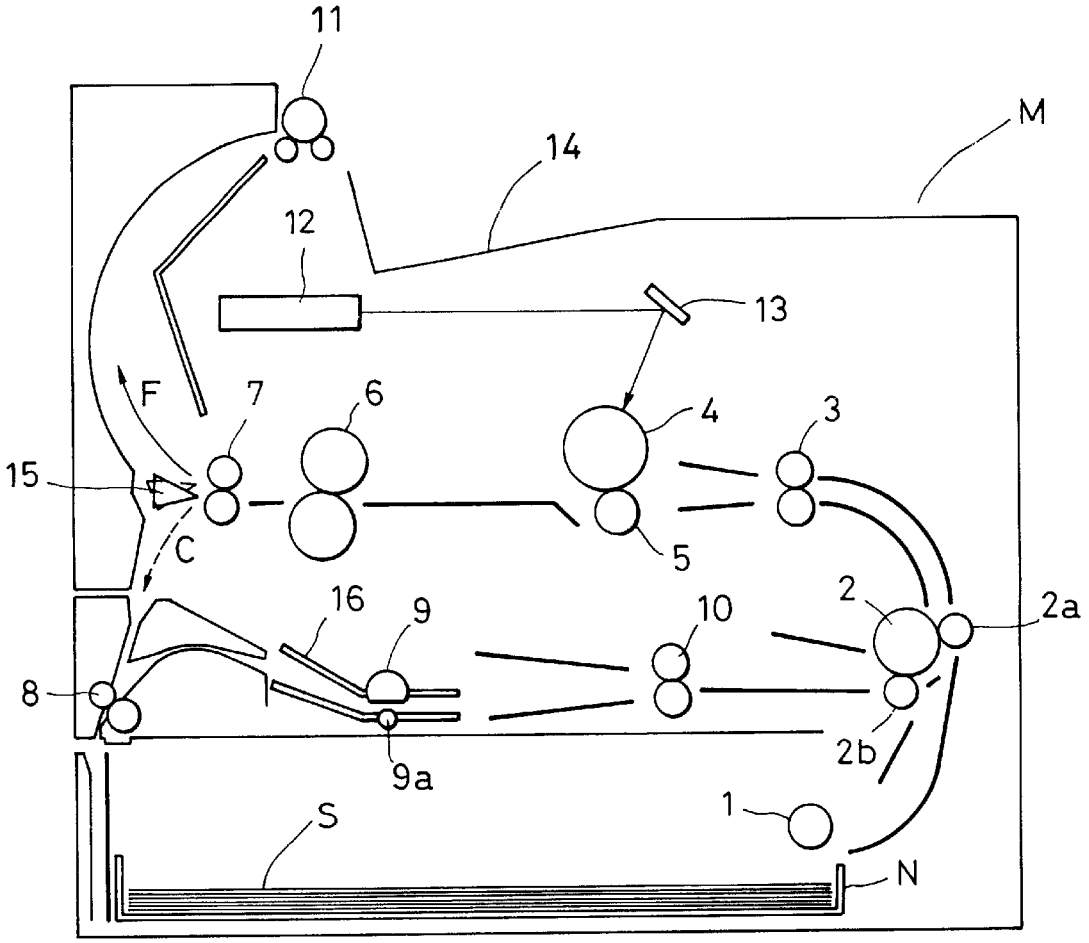
FIG. 11 PRIOR ART
FIG. 11 is a sectional view showing an overall construction of an image forming apparatus provided with a sheet material feeder according to the related art.
Figure 12:
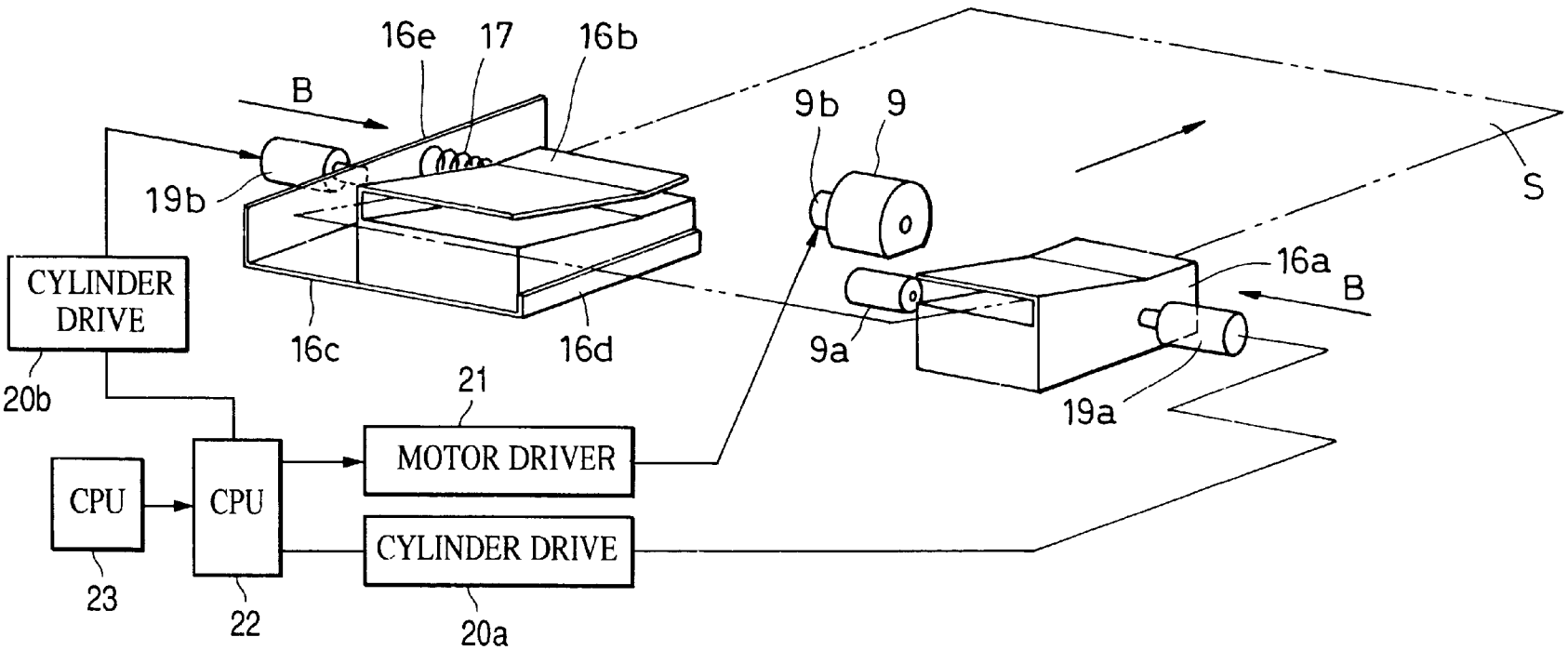
FIG. 12 PRIOR ART
FIG. 12 is a perspective view of lateral register plates of the sheet material feeder according to the related art.
Figure 13:
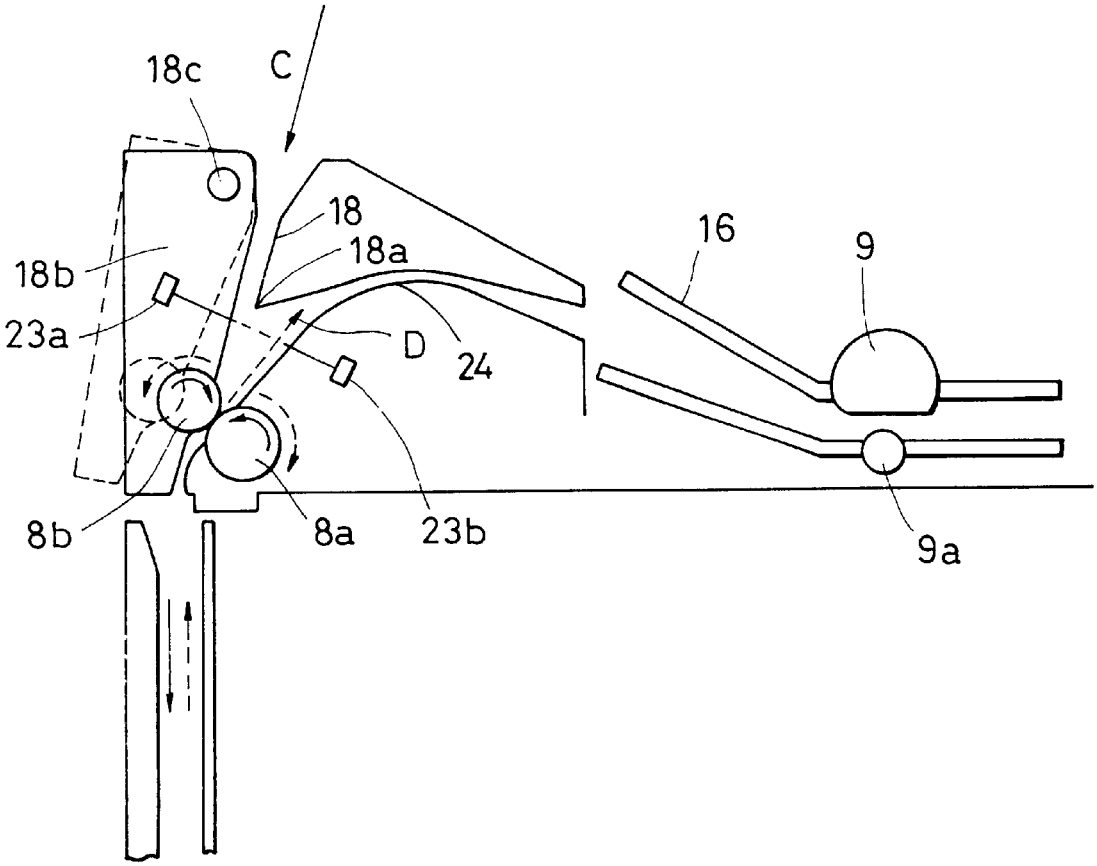
FIG. 13 PRIOR ART
FIG. 13 is a sectional view of the sheet material feeder according to the related art.
Figure 14:
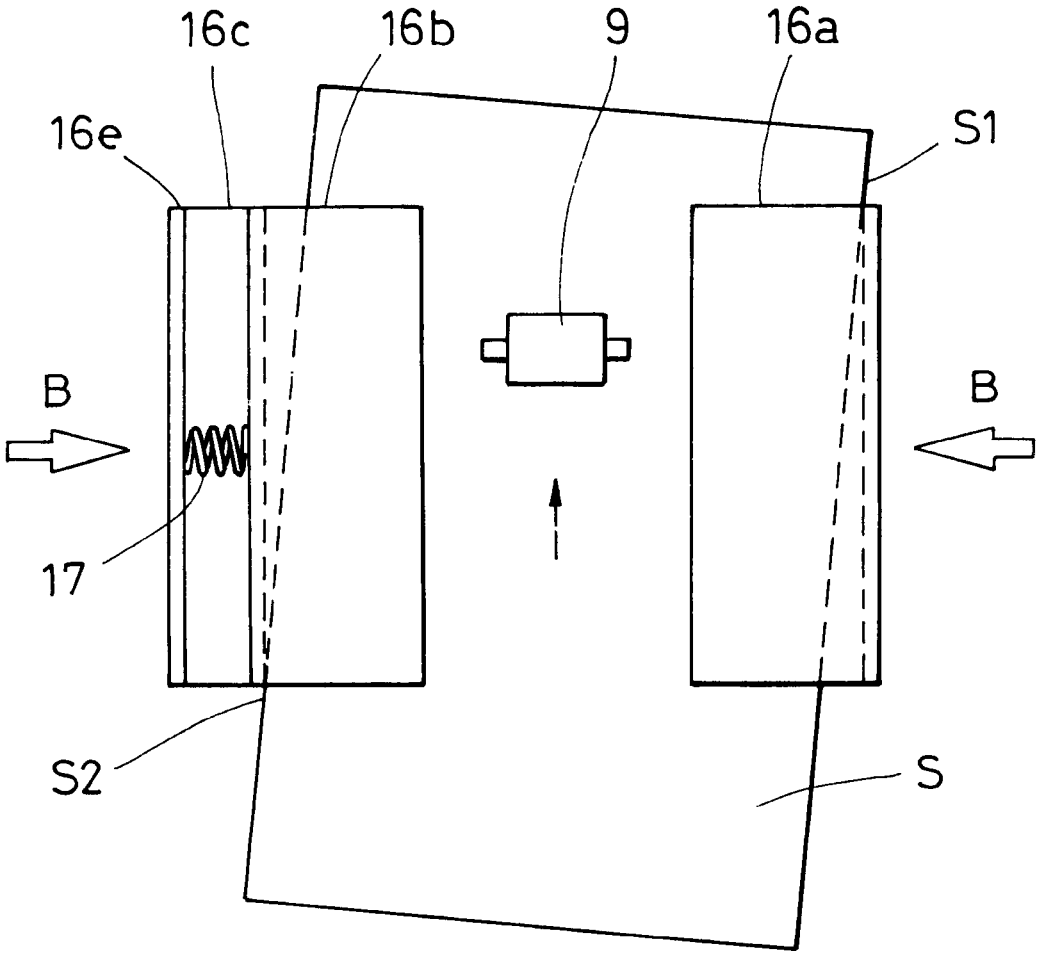
FIG. 14 PRIOR ART
FIG. 14 is a plan view of the lateral register plates of the sheet material feeder according to the related art.
Figure 15:
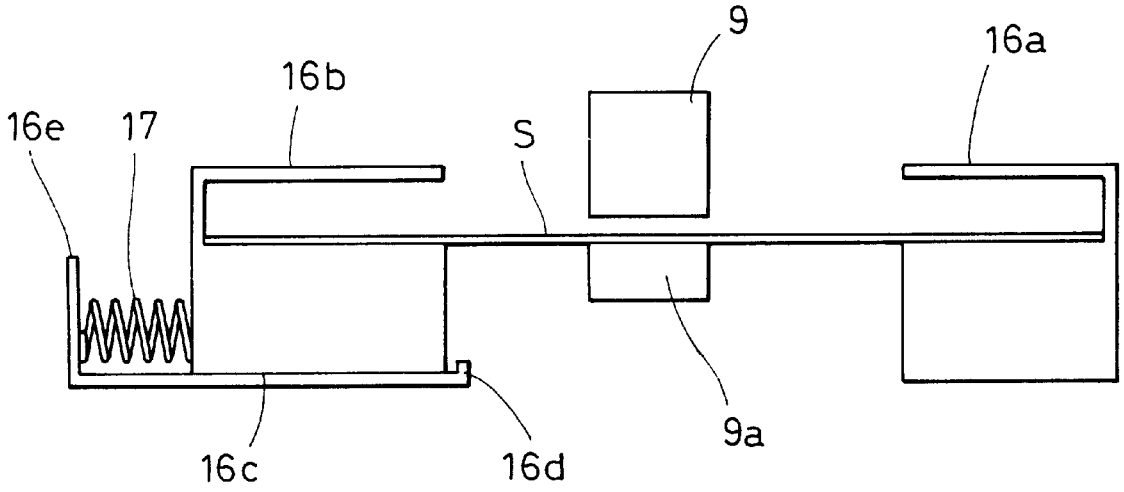
FIG. 15 PRIOR ART
FIG. 15 is a sectional view of the sheet material feeder according to the related art.
Figure 16B:
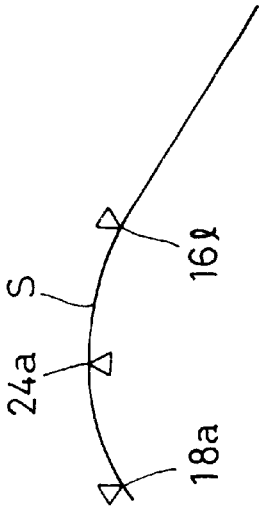
FIG. 16B PRIOR ART
FIG. 16B is a conceptual view showing a sheet material supported at three points.
Figure 16A:
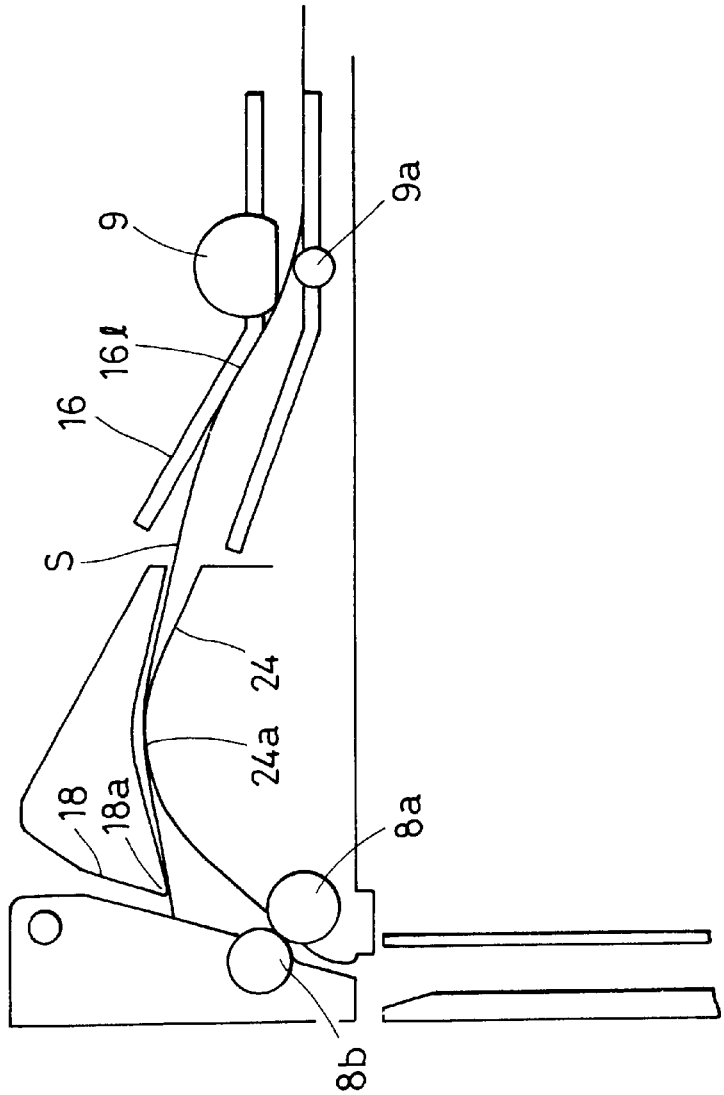
FIG. 16A PRIOR ART
FIG. 16A is a sectional view of the sheet material feeder according to the related art.

FIG. 10 shows still another example of a construction of the upper and lower sheet material guide means and the reference-side lateral register plate which are included in the above-described sheet material feeder of the first embodiment.

In this third embodiment, a sheet material transport surface 18*a* of an upper guide 18, a sheet material transport surface 24*d* of a lower guide 24, and a sheet material transport surface 16*m* of a reference-side lateral register plate 16*a* are each made of a material having a smaller coefficient of friction.

Specifically, this third embodiment utilizes a method of coating a material having a smaller coefficient of friction, such as Teflon. Such a material is coated in the sheet material transport surface 18*a* of the upper guide 18 and the sheet material transport surface 24*d* of the lower guide 24 at predetermined sheet contact positions on the side nearer to the reference-side lateral register plate 16*a* in the direction perpendicular to the direction of sheet transport.

With the above construction, when the lateral registry position of the sheet material S is adjusted, the sheet material S is supported from both sides by the three sheet material transport surfaces. Therefore, when the regulation-side lateral register plate 16*b* is moved in the direction of arrow B, the sheet material S is also smoothly moved in the same direction of arrow B. In other words, the biasing force of the compression spring 17 is not overwhelmed by the tight stretching of the sheet material S, and the regulation-side lateral register plate 16*b* can move the sheet material S toward the reference-side lateral register plate 16*a* for lateral registration.

Thus, as with the first embodiment, the lateral registry position adjustment of the sheet material S can be reliably achieved. Further, since the sheet material S is transported to the subsequent stage after removal of its skew, a possibility is reduced that the sheet material may jam somewhere in the course of a long transport path until being ejected.

An advantage specific to this third embodiment is that, since only coating is required as an additional step, the sheet material feeder can be easily manufactured with good production efficiency.

While the present invention has been described with respect to what is presently considered to be the preferred embodiments, it is to be understood that the invention is not limited to the disclosed embodiments. The present invention is intended to cover the various modifications and equivalent arrangements included within the spirit and scope of the appended claims.

What is claimed is:

1. A sheet material feeder comprising:

sheet material guide means for guiding top and bottom surfaces of a sheet material while contacting the top and bottom sheet material surfaces at a plurality of sheet contact positions, said sheet material guide means comprising a pair of S-shaped sheet material guides; and sheet-material lateral position adjusting means for pushing both side edges of the sheet material in the direction perpendicular to a direction of sheet transport, thereby adjusting a widthwise position of the sheet material contained in said sheet material guide means, wherein the sheet material is easily movable in said sheet material guide means, while in contact with the sheet contact positions, when the widthwise position of the sheet material is adjusted.

2. A sheet material feeder according to claim 1, further comprising movable projection guide means for forming the sheet contact positions of said sheet material guide means, said movable projection guide means movable in a direction perpendicular to the direction of sheet transport.

3. A sheet material feeder according to claim 2, wherein said sheet-material lateral position adjusting means comprises a pair of adjusting members, one of the pair being a reference adjusting member on a reference side, and said movable projection guide means is movable in a direction toward the reference adjusting member.

4. A sheet material feeder according to any one of claims 3 and 4, further comprising a semicircular roller having a semicircular shape in section and a roll in pressure contact with said semicircular roller, for transporting the sheet material along said sheet material guide means, wherein said roll is disposed in a state inclined in a direction to skew the sheet material toward the adjusting member positioned on the reference side.

5. A sheet material feeder according to claim 2, wherein said sheet-material lateral position adjusting means comprises a pair of adjusting members, one of the pair being a reference adjusting member on a reference side, and wherein said movable projection guide means moves in union with a base plate of the adjusting member which is positioned on the side opposite to the reference side.

6. A sheet material feeder according to claim 1, wherein surfaces of the sheet contact positions are a material having a low frictional resistance.

7. A sheet material feeder comprising:

sheet material guide means for guiding top and bottom surfaces of a sheet material while contacting the top and bottom sheet material surfaces at a plurality of sheet contact positions, said sheet material guide means comprising a pair of curved sheet material guides; and sheet-material lateral position adjusting means for pushing both side edges of the sheet material in the direction perpendicular to a direction of sheet transport, thereby adjusting a widthwise position of the sheet material contained in said sheet material guide means, wherein the sheet material is easily movable in said sheet material guide means, while in contact with the sheet contact positions, when the widthwise position of the sheet material is adjusted, and wherein rolls which are rotating in the direction perpendicular to the direction of sheet transport are provided in the sheet contact positions of said sheet material guide means.

8. A sheet material feeder according to any one of claims 6 and 7, further comprising a semicircular roller having a semicircular shape in section and a roll in pressure contact with said semicircular roller, for transporting the sheet material along said sheet material guide means, wherein said roll is disposed in a state inclined in a direction to skew the sheet material toward an adjusting member positioned on a reference side.

9. An image forming apparatus comprising a sheet material guide means for guiding top and bottom surfaces of sheet material while contacting the top and bottom sheet material surfaces at a plurality of sheet contact positions, said sheet material guide means comprising a pair of S-shaped sheet material guides; and sheet-material lateral position adjusting means for pushing both side edges of the sheet material in the direction perpendicular to a direction of sheet transport, thereby adjusting a widthwise position of the sheet material contained in said sheet material guide means, wherein the sheet material is easily movable in said sheet material guide means, while in contact with the contact sheet contact positions, when the widthwise position of the sheet material is adjusted, and image forming means for forming an image on a sheet material.

10. An image forming apparatus according to claim 9, wherein said sheet material feeder is provided in a transport path along which a sheet material having an image formed thereon by said image forming means is transported back to said image forming means.

11. An image forming apparatus according to claim 10, wherein said sheet-material lateral position adjusting means comprises a pair of adjusting members, one of the pair being a reference adjusting member on a reference side, and said movable projection guide means is movable in a direction toward the reference adjusting member.

12. An image forming apparatus according to claim 10, wherein said sheet-material lateral position adjusting means comprises a pair of adjusting members, one of the pair being a reference adjusting member on a reference side, and wherein said movable projection guide means moves in union with a base plate of the adjusting member which is positioned on the side opposite to the reference side.

13. An image forming apparatus according to claim 9, further comprising movable projection guide means for forming the sheet contact positions of said sheet material guide means, said movable projection guide means movable in a direction perpendicular to the direction of sheet transport.

14. An image forming apparatus according to claim 9, wherein surfaces of the sheet contact positions are a material having a low frictional resistance.

15. An image forming apparatus according to any one of claims 11 and 12, further comprising a semicircular roller having a semicircular shape in section and a roll in pressure contact with said semicircular roller, for transporting the sheet material along said sheet material guide means, wherein said roll is disposed in a state inclined in a direction to skew the sheet material toward the adjusting member positioned on the reference side.

16. An image forming apparatus comprising a sheet material guide means for guiding top and bottom surfaces of a sheet material while contacting the top and bottom sheet material surfaces at a plurality of sheet contact positions, said sheet material guide means comprising a pair of curved sheet material guides curving in shape; and sheet-material lateral position adjusting means for pushing both side edges of the sheet material in the direction perpendicular to a direction of sheet transport, thereby adjusting a widthwise position of the sheet material contained in said sheet material guide means, wherein the sheet material is easily movable in said sheet material guide means, while in contact with the sheet contact positions, when the widthwise position of the sheet material is adjusted, and, image forming means for forming an image on a sheet material and, wherein rolls which are rotating in the direction perpendicular to the direction of sheet transport are provided in the sheet contact positions of said sheet material guide means.

17. An image forming apparatus according to any one of claim 13, 14, and 16, further comprising a semicircular roller having a semicircular shape in section and a roll in pressure contact with said semicircular roller, for transporting the sheet material along said sheet material guide means, wherein said roll is disposed in a state inclined in a direction to skew the sheet material toward an adjusting member positioned on a reference side.

* * * * *

UNITED STATES PATENT AND TRADEMARK OFFICE

CERTIFICATE OF CORRECTION

PATENT NO. : 6,402,139 B1
DATED : June 11, 2002
INVENTOR(S) : Takuma Kanno

It is certified that error appears in the above-identified patent and that said Letters Patent is hereby corrected as shown below:

Column 2,
Line 47, "are" should read -- is --.

Column 7,
Line 19, "both the" should read -- both --.

Column 12,
Line 58, "claim" should read -- claims --.

Signed and Sealed this

Seventeenth Day of September, 2002

*Attest:*

*Attesting Officer*

JAMES E. ROGAN
*Director of the United States Patent and Trademark Office*